United States Patent [19]

Tanaka

[11] Patent Number: 4,964,281

[45] Date of Patent: Oct. 23, 1990

[54] LOW-TEMPERATURE SHOWCASE

[75] Inventor: Tsutomu Tanaka, Oizumi, Japan

[73] Assignee: Sanyo Electric Co., Ltd., Osaka, Japan

[21] Appl. No.: 415,092

[22] Filed: Sep. 29, 1989

[30] Foreign Application Priority Data

Oct. 6, 1988 [JP] Japan ..... 63-252393

[51] Int. Cl.[5] ..... A47F 3/04

[52] U.S. Cl. ..... 62/256

[58] Field of Search ..... 62/256

[56] References Cited

U.S. PATENT DOCUMENTS

| | | | |
|---|---|---|---|
| 4,312,190 | 1/1982 | Ibrahim et al. | 62/256 X |
| 4,648,247 | 3/1987 | Takizawa et al. | 62/256 |
| 4,691,527 | 9/1987 | Ikeda | 62/256 X |
| 4,741,171 | 5/1988 | Toshiyuki | 62/256 X |

*Primary Examiner*—William E. Tapolcai

*Attorney, Agent, or Firm*—Darby & Darby

[57] ABSTRACT

A low-temperature showcase in which a double air curtain can be formed for a commodity inlet-outlet opening provided in one side of the case main body having a heat exchanger in an inner passage positioned upstream of and at a predetermined distance from another heat exchanger in an outer passage with respect to the same direction of air flows in the two passages, a partition wall defining the inner and outer passages and having a window at a portion thereof between the two heat exchangers, a passage change-over device for opening or closing the window to close or open the inner passage downstream of the window, a blower in each of said passages, and a control unit for giving instructions to the blowers and the passage change-over device for their operation, the control unit instructing the blowers to move air through the two passages in a first direction when at least the inner passage heat exchanger is operating for refrigeration and the control means instructing the passage change-over means to open the window and cause the blowers to operate to direct a part of the air flowing in the outer passage to flow through the open window into the inner passage and its heat exchanger in a second direction which is opposite to the first direction.

7 Claims, 6 Drawing Sheets

LOW-TEMPERATURE SHOWCASE

BACKGROUND OF THE INVENTION

1. Field of the Invention

The present invention relates to low-temperature showcases, and more particularly to a low-temperature showcase in which a double air curtain can be formed for a commodity inlet-outlet opening provided in one side of its main body.

2. Related Art Statement

Conventional low-temperature showcases of this type include an open showcase which comprises a case main body having in one side thereof an inlet-outlet opening for commodities and including an inner wall, an outer wall and a partition wall defining between the inner and outer walls an inner passage and an outer passage for passing air therethrough, two heat exchangers disposed in the inner and outer passages respectively for providing refrigeration cycles along with a compressor, condenser and reducing valves, and two blowers disposed in the inner and outer passages respectively for passing air through the two passages in the same direction, so that at least a double air curtain can be formed for the opening with the air circulated through the inner and outer passages.

Among low-temperature showcases of this type, that disclosed in the specification and the accompanying drawings in U.S. Pat. No. 4,648,247 and that presented as a freezer disclosed in Japanese Patent Publication No. 58082/1988 have a common construction in which a heat exchanger and a blower are disposed in each of inner and outer passages respectively, and air curtains are made alongside of each other in an opening by air circulated through the passages during refrigeration operation of the inner heat exchanger. Further in the showcases, the outer heat exchanger is disposed downstream of the inner heat exchanger with regard to flow of the circulated air, a partition plate between outer and inner walls defines the inner and outer passages, the partition wall is provided with a window between the inner and outer heat exchangers so that the outer and inner passages communicate with each other through the window and also provided with a damper movable for opening and closing the window, which is in the opening position during refrigeration operation of the outer heat exchanger. The inner heat exchanger, when operated for defrosting, is forcibly heated with a refrigerant such as a hot gas, a liquid refrigerant and a gas-liquid mixed refrigerant, serving as a heat source for defrosting. In this way, frost built up on the inner heat exchanger is removed.

In accordance with the aforementioned prior art, when the inner heat exchanger functions as an evaporator for refrigeration, a cold air flowing across the opening is below the freezing point in temperature, and also it is kept below the freezing point in temperature while flowing through the inner passage to return to the inner heat exchanger after the crossing of the opening. As a result, the surface of a drain receiver usually formed on the bottom of the inner passage is kept below the freezing point in temperature.

When the refrigeration operation ends and defrosting operation starts in the inner heat exchanger, the inner heat exchanger is forcibly heated with a refrigerant serving as a heat source for defrosting. Consequently, frost built up on the inner heat exchanger gradually melts into pieces of ice and/or drain water to fall down on the bottom of the drain receiver. The surface of the drain receiver is kept below the freezing point in temperature as has been described. Further, air heated in the inner heat exchanger during the defrosting operation of the inner heat exchanger flows through the window into the outer heat exchanger serving as an evaporator and is subjected to heat exchange to be cooled, and thereafter the cooled air in the inner passage is kept at about 0° C. in temperature from the middle of the defrosting operation to the latter period thereof although it experiences a slight increase in temperature when flowing across the opening. Accordingly, it takes a longer period of time for the temperature of the drain receiver to rise to 0° C. or over, and hence it takes a great deal of time for pieces of ice falling down on the drain receiver to melt. Also, the drain receiver is ill drained due to the pieces of ice. This causes the pieces of ice to gradually grow into blocks of ice and also causes drain water to be frozen into an ice sheet. These ice blocks and ice sheet impedes the passage of a circulated air, so that the flow rate and flow velocity of the air curtain are reduced, and frozen load in the opening is increased.

SUMMARY OF THE INVENTION

A low-temperature showcase according to the present invention comprises a case main body having at one side thereof an inlet-outlet opening for commodities and including an inner wall, an outer wall and a partition wall defining between the inner and outer walls an inner passage and an outer passage for passing air therethrough, the partition wall having a window at a portion thereof between two heat exchangers; the two heat exchangers disposed in the inner passage and the outer passage respectively for providing refrigeration cycles along with a compressor, a condenser and reducing valves, the heat exchanger in the inner passage being positioned upstream of and at a predetermined distance from the heat exchanger in the outer passage with respect to the same direction of air flows; blowers disposed in the inner and outer passages respectively for passing air through the two passages in the same direction and adapted to form at least a double air curtain at the inlet-outlet opening with the air circulated through the inner and outer passages when at least the heat exchanger in the inner passage is operated for refrigeration; passage change-over means for opening or closing the window, and control means applying the passage change-over means instructions to open the window and controlling the operation of each of the two blowers when the heat exchanger in the inner passage is operated for defrosting and the heat exchanger in the outer passage is operated for refrigeration, whereby a part of the air passing through the outer passage flows from the opened window into the heat exchanger in the inner passage in a direction reverse to that during the exchanger in the outer passage is operated for refrigeration.

Thus, in the low-temperature showcase of the present invention, specified control means applies instructions to open the window and to operate the two blowers under its control when the heat exchanger in the inner passage is operated for defrosting.

More specifically, according to the present invention, when the heat exchanger in the inner passage is operated for defrosting and the heat exchanger in the outer passage is operated for refrigeration, the control means applies instructions not only to open the window but also to operate the two blowers under its control, whereby a part of air passing through the outer passage flows through the opened window into the heat exchanger in the inner passage in a direction reverse to the direction of air flow during the refrigeration operation of the heat exchanger in the outer passage. In this way, circulated air heated in the inner heat exchanger warms the drain receiver usually provided on the bottom of the inner passage. As a result, a period of time required for temperature rise in the surface of the drain receiver to 0° C. or over is shortened, and therefore re-freezing of the pieces of ice and/or drain water is avoided. When the heat exchanger in the inner passage resumes refrigeration operation, there is no pile up (blocks of ice) in the inner passage, and therefore nothing impedes the passage of circulated air. Thus, there is no possibility that the flow rate and flow velocity of the air curtain are reduced, and increase in frozen load in the opening can be avoided.

BRIEF DESCRIPTION OF THE DRAWINGS

All the drawings show embodiments of a low-temperature showcase according to the present invention, wherein.

DETAILED DESCRIPTION OF THE PREFERRED EMBODIMENTS

Embodiments according to the present invention will now be described in conjunction with the drawings.

Figure 1:
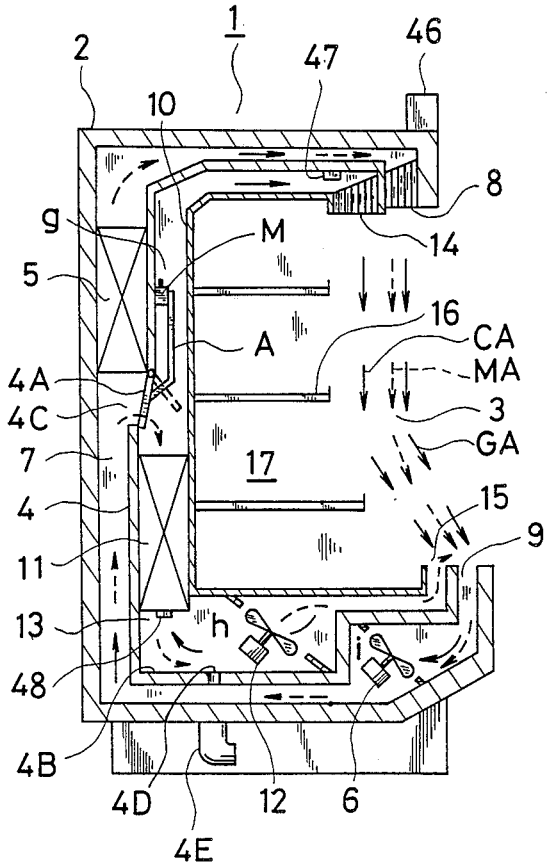
FIG. 1 is a sectional view of an embodiment of the low-temperature showcase.

FIG. 1 shows a low-temperature open showcase 1, the main body of which has an inlet-outlet opening 3 for commodities at its front side and is made of a heat insulating (or an outer wall). The main body has in its interior a first partition plate (or a partition wall) 4 of heat insulating properties at a suitable distance from the inner surface of the heat insulating wall 2. The first partition plate 4 has a damper 4A as passage change-over means openable toward the inner passage to be described below and a window 4C closed by this damper. An outer passage 7 is defined by the partition plate 4 and the insulating wall 2. An outer heat exchanger 5 of plate fin type and an outer blower 6 of axial flow type are disposed in the outer passage 7. The outer passage 7 has an air outlet 8 along the upper edge of the opening 3 and an air inlet 9 provided along the lower edge of the opening 3 and opposed to the outlet 8. A second partition plate (or an inner wall) 10 of metal as an inner wall is disposed inwardly of the first partition plate 4 at a suitable distance therefrom to define an inner passage 13 by the plates 10 and 4. An inner heat exchanger 11 of plate fin type and an inner blower 12 of axial flow type are disposed in the inner passage 13. The inner passage 13 has an air outlet 14 along the upper edge of the opening 3 inwardly of the air outlet 8 and an air inlet 15 provided alongside the outer air inlet 9 inside thereof and opposed to the air outlet 14. The interior space of the main body serves as a storage chamber 17 having a plurality of shelves 16. The damper 4A is a metal plate with a heat insulating sheet adhering thereto. Also, the damper 4A is disposed upstream from the inner heat exchanger 11 with regard to the direction of flow of the air to be circulated. Preferably, the free end of the damper 4A comes into contact with the outer surface of the second partition plate 10 when the damper is opened. The damper 4A is upstream from the outer heat exchanger 5 in the outer passage 7. The damper 4A is moved between opening and closing positions by a driving system including a gear motor M with a deceleration mechanism, a thin, long arm A converting the rotational movement of the gear motor M into reciprocal movement. The first partition plate 4 is provided with a drain receiver 4B in the bottom and the drain receiver is formed with a drain hole 4D. A drain pipe 4E is attached to the bottom of the heat insulating wall under the drain receiver 4B.

Figure 2:
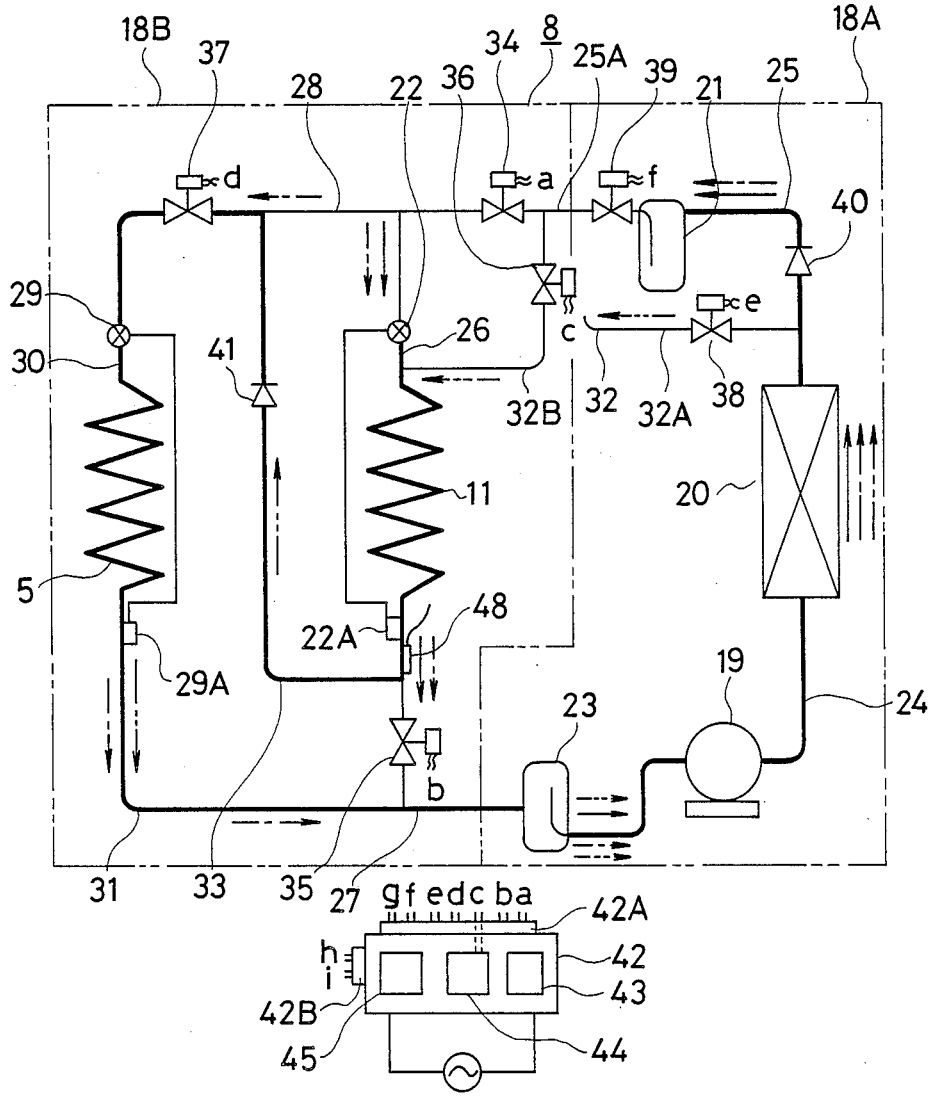
FIG. 2 is a diagram illustrating a refrigerant circuit in the embodiment.

FIG. 2 shows a refrigerator 18 for cooling the showcase. The refrigerator 18 comprises a refrigerant compressor 19, a water- or air-cooled heat exchanger 20 serving as a condenser, a receiver 21, a reducing valve 22, such as expansion valve or the like, having a temperature sensor 22A, the inner heat exchanger 11 and a gas-liquid separator 23. These components are connected into a loop by a high-pressure gas pipe 24, a high-pressure liquid pipe 25, a first low-pressure liquid pipe 26 and a low-pressure gas pipe 27. The refrigerator 18 further comprises a high-pressure liquid branch pipe 28 having its inlet connected between opposite ends of the high-pressure liquid pipe 25, a reducing valve 29, such as an expansion valve, having a temperature sensor 29A, a second low-pressure liquid pipe 30 and a low-pressure gas branch pipe 31 having its outlet connected between opposite ends of the low-pressure gas pipe 27. These components are connected to dispose the outer heat exchanger 5 in parallel with the inner heat exchanger 11. A by-pass circuit 32 formed of first and second by-pass pipes 32A, 32B conducts a high-pressure refrigerant to the inner heat exchanger 11. The first by-pass pipe 32A has its inlet connected to the high-pressure liquid pipe 25 between the condenser 20 and the receiver 21 and its outlet connected to the pressure liquid pipe 25 between the receiver 21 and the reducing valve 22 in a position closer to the receiver 21. The second by-pass pipe 32B has its inlet connected to the high-pressure liquid pipe 25 between the receiver 21 and the reducing valve 22 downstream from the outlet of the first by-pass pipe 32A with regard to the direction of flow of the refrigerant and its outlet connected between opposite ends of the first low-pressure liquid pipe 26. The outlet of the first by-pass pipe 32A and that of the second by-pass pipe 32B are connected to the high-pressure liquid pipe 25 to make a common conduit 25A in a part of the high-pressure liquid pipe 25, and thus a part of the by-pass circuit 32 is formed. The common conduit 25A extends several meters to several tens of meters. A connecting pipe 33 conducts the high-pressure liquid refrigerant in the inner heat exchanger 11 to the outer heat exchanger 5 when the inner heat exchanger 11 is operated for defrosting. The connecting pipe 33 has its inlet connected to the low-pressure gas pipe 27 between the inner heat exchanger 11 and the gas-liquid separator 23 and its outlet connected between opposite ends of the high-pressure liquid branch pipe 28. First to sixth electromagnetic valves 34–39 are moved between opening and closing positions as required to switch the passage for flow of the circulating refrigerant. The first electromagnetic valve 34 is mounted on the high-pressure liquid pipe 25 between the reducing valve 22 and the common conduit 25A, so that it is opened during refrigeration operation of the inner heat exchanger 11 and refrigeration operation of each of the inner and outer heat exchangers 11, 5, and it is closed during defrosting operation of the inner heat exchanger 11 and pump-down operation thereof. The second electromagnetic valve 35 is mounted on the low-pressure gas pipe 27 between the inlet of the connecting pipe 33 and the outlet of the low-pressure gas branch pipe 31, and the switching operation of the valve 35 is similar to that of the first electromagnetic valve 34. The third electromagnetic valve 36 is mounted on the second by-pass pipe 32B, and it is merely opened during the defrosting operation of the inner heat exchanger 11. The fourth electromagnetic valve 37 is mounted on the high-pressure liquid branch pipe 28 between the outlet of the connecting pipe 33 and the reducing valve 29, and it is opened except the duration of the defrosting operation of the inner heat exchanger 11. The fifth electromagnetic valve 38 is mounted on the first by-pass pipe 32A. The switching operation of the valve 38 is similar to that of the third electromagnetic valve 36, and it is merely opened during the defrosting operation of the inner heat exchanger 11. The sixth electromagnetic valve 39 is mounted on the high-pressure liquid pipe 25 between the receiver 21 and the common conduit 25A, and the switching of the valve 39 is similar to that of the first and second electromagnetic valves 34, 35. A check valve 40 is mounted on the high-pressure liquid pipe 25 between the inlet of the first by-pipe 32A and the receiver 21 to prevent a remaining refrigerant within the receiver 21 from flowing in the reverse direction toward the inlet of the first by-pass pipe 32A because of the ejector effect by the high-pressure refrigerant passing through the by-pass circuit 32 during the defrosting operation of the inner heat exchanger 11. A check valve 41 is mounted on the connecting pipe 33 to prevent the high-pressure liquid refrigerant passing through the high-pressure liquid pipe 25 and the high-pressure liquid branch pipe 28 from flowing from the connecting pipe 33 to the low-pressure gas pipe 27 during the refrigeration operation of the inner heat exchanger 11 and that of the inner and outer heat exchangers 11, 5.

The refrigerator 18 is sectioned into two parts; namely, a condenser unit illustrated in a dash-dot line 18A in FIG. 1, placed in a machine room in a store and a cooling unit illustrated in a dash-dot line 18B, placed in a sales floor of the store. Accordingly, the common conduit 25A connecting both the units may be several tens of meters in some store. A control unit 42 includes a microcomputer which contains a main timer 43. A controller 42A gives instructions to open or close each of the first to sixth electromagnetic valves 34–39 and to drive or stop the gear motor M for a predetermined period of time by applying a signal through each of signal lines "a"–"g". Thus, the refrigeration operation, evaporative refrigeration operation, defrosting operation and pump-down operation to be described below are done sequentially and repeatedly. On the other hand, a controller 42B gives the blowers 12, 6 instructions to rotate forward or reverse or to stop under its control by applying a signal through each of signal lines "h", "i". A subtimer 44 is connected to the signal line "c" for the third electromagnetic valve 36 which is opened during the defrosting operation to count a period of time for which the third electromagnetic valve 36 is opened, namely a conduction time of electricity. The period of time counted by the subtimer 44 is indicated by a indicator 45. The signal line "a" is connected to the first electromagnetic valve 34, the line "b" to the second electromagnetic valve 35, the line "c" to the third electromagnetic valve 36, the line "d" to the fourth electromagnetic valve 37, the line "e" to the fifth electromagnetic valve 38, the line "f" to the sixth electromagnetic valve 39 and the line "g" to the gear motor M, respectively.

A temperature sensor 46 controls opening and closing operation for each of the first and second electromagnetic valves 34, 35. The temperature sensor 46 has its sensing unit 47 disposed on the leeward of the outlet 14 of the inner passage 13. The sensing unit 47 senses a temperature of a cold air subjected to heat exchange in the inner heat exchanger 11. The first and second electromagnetic valves 34, 35 are switched on or off, namely opened or closed on the basis of sensed temperature. The opening and closing operation of each of the first and second electromagnetic valves 34, 35 is controlled preferentially by the main timer 43 rather than the temperature sensor 46, and this arrangement is made in advance.

A thermostat 48 senses completion of defrosting and controls the third and fifth electromagnetic valves 36, 38. The thermostat is disposed on the leeward of the inner heat exchanger 11 or on the low-pressure gas pipe 27 as shown in FIG. 2 to close the third and fifth electromagnetic valves 36, 38 with the refrigerant temperature of +6° C., for example. The opening operation of each of the third and fifth electromagnetic valves 34, 38 is carried out in response to a signal from the main timer 43.

The low-temperature showcase is operated in the following manner.

Now, the damper 4A is closed to render the inner passage 13 and the outer passage 7 independent of each other as shown in FIG. 1. At this time, the first, second and sixth electromagnetic valves 34, 35, 39 are opened, and the third, fourth and fifth electromagnetic valves 36, 37, 38 are closed. When the refrigerant compressor 19 is operated in this state, the refrigerant flows through the channel of: compressor 19—condenser 20—receiver 21—sixth electromagnetic valve 39—first electromagnetic valve 34—reducing valve 22—inner heat exchanger 11 serving as an evaporator—second electromagnetic valve 35—gas-liquid separator 23—compressor 19 to provide a first cycle. During this cycle, the refrigerant is condensed by the heat exchanger 20, has its pressure reduced by the reducing valve 22 and is evaporated by the inner heat exchanger 11. During this refrigeration operation (which is conducted, for example, for 4 hours), the air circulated through the inner passage 13 by the inner blower 12 is subjected to heat exchange with a low-pressure liquid refrigerant passing through the inner heat exchanger 11 and having an evaporation temperature of −15° C., for example, to become a cold air of −6° C., for example, forming a cold air curtain CA across the opening 3 as indicated by solid arrows in FIG. 1 to keep the temperature in the storage chamber 17 at −4° C. and keep stored goods at an appropriate temperature (at a temperature range of 0° C. or below where a living cell can be kept alive), for example, at −2° C. In the meantime, the first and second electromagnetic valves 34, 35 are turned on and off at the same time in response to a signal from a sensor 46 sensing a temperature of the cold air blown to the opening 3 to maintain the chamber 17 at the appropriate temperature (in the temperature range of 0° C. or below). On the other hand, the air circulated through the outer passage 7 by the outer blower 6 flows across the opening 3 along the cold air curtain CA outside thereof as indicated by solid arrows in FIG. 1 and is cooled to a slightly lower temperature than that of the outside air surrounding the low-temperature showcase 1 due to the cold air curtain, thus serving as a guard air curtain GA for holding the cold air curtain CA out of contact with the outside air.

When an increased amount of frost build up on the inner heat exchanger 11 with the progress of refrigeration operation, the fourth electromagnetic valve 37 is opened in response to a signal from the controller 42, permitting the liquid refrigerant to partly flow into the high-pressure liquid branch pipe 28. The liquid refrigerant through the pipe 28 has its pressure reduced by the reducing valve 29, is evaporated by the outer heat exchanger 5 serving as an evaporator, flows through the low-pressure gas branch pipe 31 into the low-pressure gas pipe 27 and joins the refrigerant in the form of low-pressure gas and passing through the inner heat exchanger 11. The combined refrigerant returns to the compressor 19. Thus, the refrigerant provides a second cycle indicated in dash-dot lines in FIG. 2. The operation of the second cycle is performed for several tens of seconds to several minutes before the refrigeration operation finishes, i.e. immediately before the refrigeration operation is changed over to defrosting operation, whereby the outer heat exchanger 5 is cooled to a lower temperature like the inner heat exchanger 11. Consequently, the air circulating through the outer passage 7 is subjected to heat exchange with the low-pressure liquid refrigerant (whose evaporation temperature is −20° C.) flowing through the outer heat exchanger 5 and maintained at the same temperature as, or a slightly higher temperature than (approximately −4° C.), the cold air circulated through the inner passage 13.

During the refrigeration operation, a defrosting start signal is emitted from the controller 42. In response to this signal, the first, second and sixth electromagnetic valves 34, 35, 39 are closed, the third and fifth electromagnetic valves 36, 38 are opened, the damper 4A is opened inwardly as shown in a phantom line in FIG. 1 and the inner blower 12 alone is stopped. As a result, the outer heat exchanger 5 continues the refrigeration operation while the inner heat exchanger 11 switches to the defrosting operation, whereupon the subtimer 44 starts to count a defrosting time. A high pressure refrigerant, namely high-pressure gas-liquid refrigerant from the condenser 20 then flows through the circuit of: by-pass circuit 32—inner heat exchanger 11—connecting pipe 33—fourth electromagnetic valve 37—reducing valve 29—outer heat exchanger 5—gas-liquid separator 23—compressor 19 to provide a third cycle indicated in dash-two dot lines in FIG. 2. The third cycle requires, for example, 10 to 20 minutes. During this cycle, the defrosting operation of the inner heat exchanger 11 and the refrigeration operation of the outer heat exchanger 5 are simultaneously done. The high-pressure gas-liquid mixed refrigerant from the by-pass circuit 32 flows in the inner heat exchanger 11 downward from the upper portion, whereupon the refrigerant is subjected to heat exchange with a minor circulated air described below to be a supercooled liquid of approximately 5° C. Sensible heat produced during the change of temperature gradually defrosts the inner heat exchanger 11.

Meanwhile, the inner blower 12 is stopped but the outer blower 6 is worked, so that the pressure in the outer passage 7 is lower than that in the inner passage 13. This renders air circulated to the outer heat exchanger 5 partly flow through the window 4C to the inner passage 13. Specifically, the circulated air is divided in to a major circulated air which takes a route of: outer heat exchanger 5—outer air outlet 8—opening 3—outer air inlet 9—outer heat exchanger 5 and the above mentioned minor circulated air which takes a route of: window 4C—inner heat exchanger 11—inner air inlet 15—outer air inlet 9—window 4C, as shown in broken lines in FIG. 1. The temperature of the minor circulated air is below the freezing point at the beginning of the third cycle because the minor circulated air is a part of the major circulated air before subjected to heat exchange in the outer heat exchanger 5. In the middle of the third cycle or later, however, the temperature of the minor circulated air rises above the freezing point because the minor circulated air is gradually heated by the inner heat exchanger 11. Accordingly, pieces of ice falling from the surface of the inner heat exchanger 11 are melted by the air flowing along the drain reciever 4B. The evaporation temperature of the above mentioned major circulated air further goes down because a part thereof flows through the window 4C into the inner passage 13; for example, the major circulated air is subjected to heat exchange to be −10° C. in temperature by passing through the outer heat exchanger 5 of which temperature goes down by −5° C. The cooled major circulated air goes out of the outer air outlet 8 and flows across the opening 3 to make a cold air curtain MA, flows into the outer passage 7 from the outer air inlet 9 along with the minor circulated air higher in temperature. After the temperature goes up about 0° C., a most part of the combined air is again subjected to heat exchange in the outer heat exchanger 5, and a part thereof flows from the window 4C to the inner heat exchanger 13 as the minor circulated air. The flow rate of the air curtain MA is smaller than the flow rate of each of the air curtains CA, GA because the air curtain MA is a flow of the major circulated air a part of which takes another route as the minor circulated air. Therefore, the temperature of the major circulated air considerably rises while it flow across the opening 3; the temperature immediately after the major circulated air passes the outer air inlet 9 is over 0° C.

Further, the inner blower is rotated slowly in the reverse direction to increase the amount of air flowing from the outer passage 7 into the inner passage 13, whereby the inner heat exchanger 11 is rapidly defrosted and the drain receiver 4B is rapidly heated.

When the inner heat exchanger 11 is defrosted and the temperature in the inner passage 13 goes up with the progress of the defrosting operation in the third cycle, the first, second and sixth electromagnetic valves 34, 35, 39 are kept closed while the thermostat 48 functions to close the third and fifth electromagnetic valves 36, 38. Then, the subtimer 44 ends counting and, simultaneously, supply of the high-pressure gas-liquid mixed refrigerant serving as a heat source for defrosting to the inner heat exchanger 11 is stopped. As a result, the liquid refrigerant (partly containing a saturated gas) remaining in the inner heat exchanger 11 is collected in the receiver 21, which is generally called pump-down operation. During the pump-down operation, the liquid refrigerant in the inner heat exchanger 11 flows through the connecting pipe 33—fourth electromagnetic valve 37—reducing valve 29—outer heat exchanger 5—gas-liquid separator 23—compressor 19—condenser 20—receiver 21 as shown in thick lines in FIG. 2 and is stored in the receiver 21 as a high-pressure liquid refrigerant.

The pump-down operation is performed for several minutes in the end of the defrosting operation of the inner heat exchanger 11. During the pump-down operation, the saturated gas and liquid refrigerant of the refrigerant in the inner heat exchanger 11 are absorbed by the outer heat exchanger 5 in order. As a result, a part of the refrigerant is evaporated into gas state in the inner heat exchanger 11, and latent heat due to the vaporization causes the inner heat exchanger 11 to be cooled. Further, the refrigerant flowing from the reducing valve 29 to the outer heat exchanger 5 in the state of liquid refrigerant becomes a low-pressure liquid refrigerant and is evaporated into gas state while it passes the outer heat exchanger 5, and latent heat due to the vaporization causes the outer heat exchanger 5 to be cooled. A period of time required for the pump-down operation corresponds to that for dewatering of dew drops on the inner heat exchanger 11.

In the end of the pump-down operation, the inner blower 12 is worked, the forth electromagnetic valve 37 is closed, the first, and second and sixth electromagnetic valves 34, 35, 39 are opened, so that the refrigeration operation shown in solid arrows in FIG. 2 is resumed.

Figure 3:
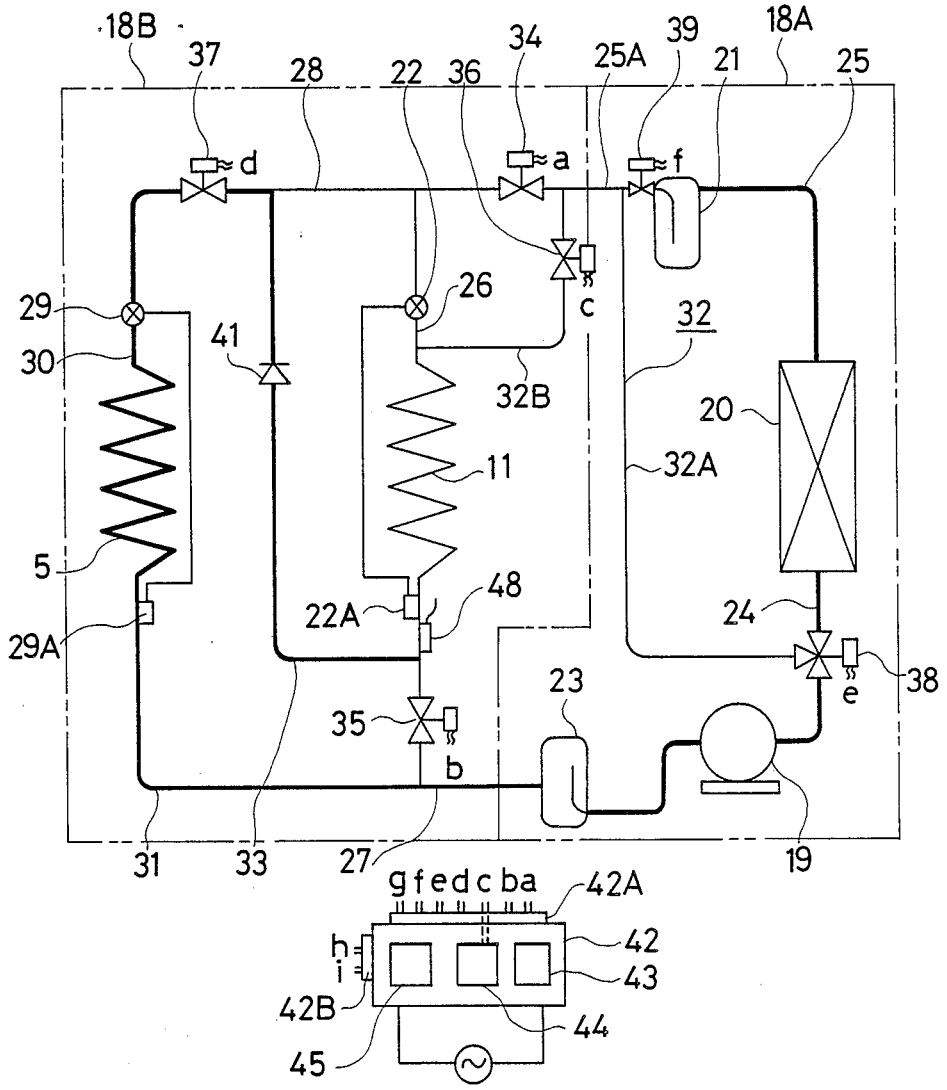
FIGS. 3 and 4 are diagrams illustrating refrigerant circuits in other embodiments.

FIG. 3 illustrates another embodiment according to the present invention. In this embodiment, a hot gas, or a high-pressure gas refrigerant, is used as a heat source for defrosting the inner heat exchanger 11. Therefore, an inlet of the by-pass pipe 32 is positioned in the middle of the high-pressure gas pipe 24, and the fifth electromagnetic valve 38 is a three way electromagnetic valve. FIG. 3 shows the operation in the first to third cycles and pump-down operation; the refrigerant flows as shown in thick lines during the pump-down operation.

Figure 4:
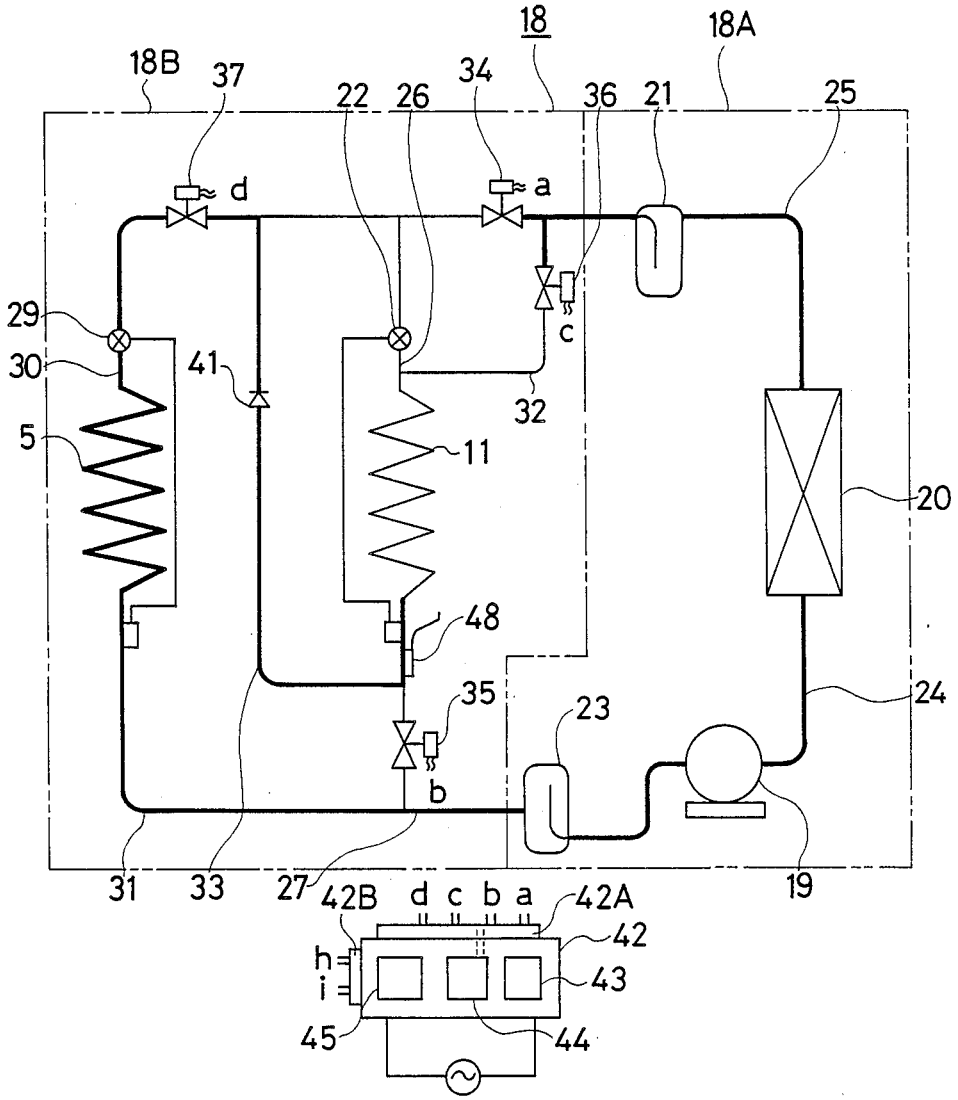

FIG. 4 shows still another embodiment according to the present invention. In this embodiment, high-pressure liquid refrigerant from the receiver 21 is used as a heat source for defrosting the inner heat exchanger 11. Therefore, an inlet of the by-pass pipe 32 is positioned in the high-pressure liquid pipe 25 between the receiver 21 and the first electromagnetic valve 34. FIG. 4 shows the aforementioned first to third cycles and pump-down operation; the refrigerant flows as shown in thick lines during the pump-down operation.

The heat source for defrosting the inner heat exchanger 11 is selected from a high-pressure gas-liquid mixed refrigerant, hot gas and high-pressure liquid refrigerant in accord with a set point of the temperature in the storage chamber 17 and environmental requirements of the low-temperature showcase 1.

Figure 5:
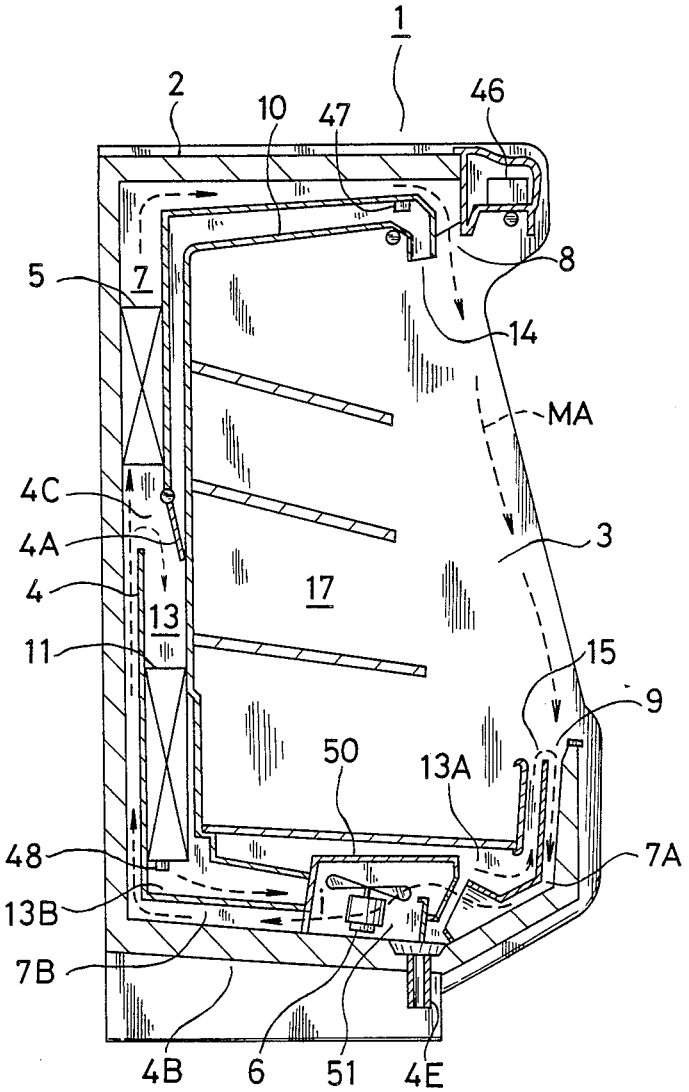
FIG. 5 is a sectional view illustrating still another embodiment of the low-temperature showcase.
Figure 6:
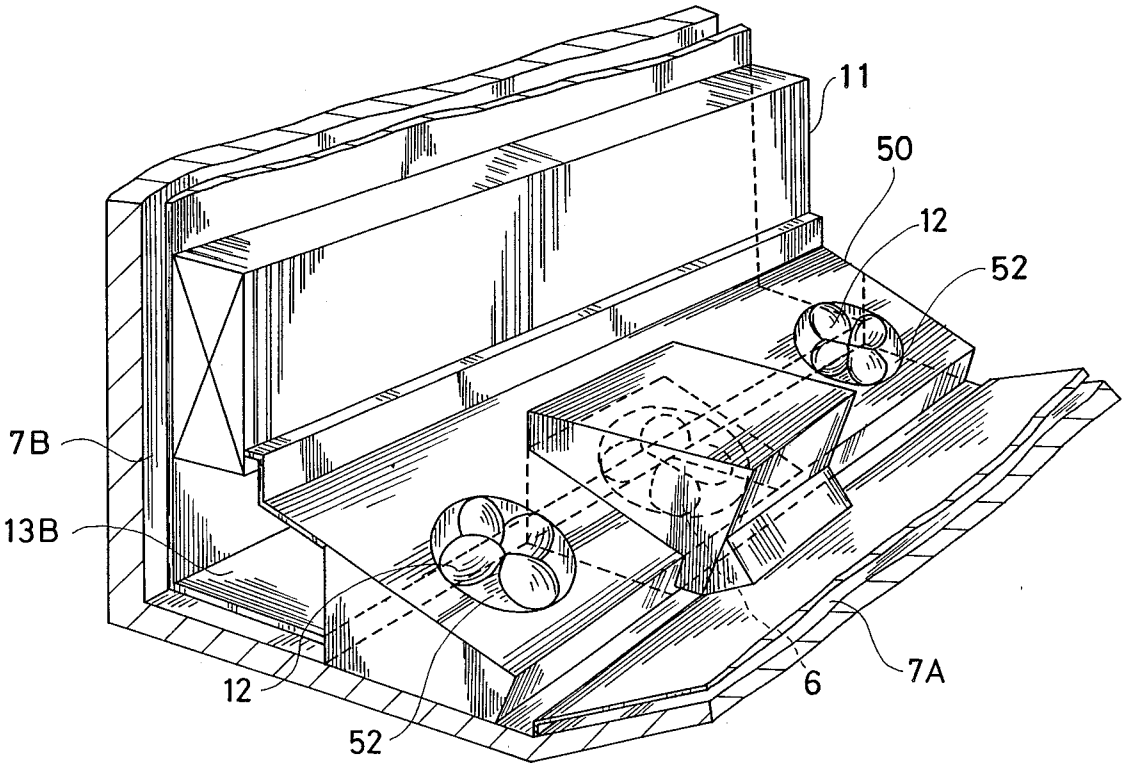
FIG. 6 is a perspective view illustrating a main portion of the low-temperature showcase of FIG. 5.

FIGS. 5 and 6 show yet another embodiment according to the present invention. Reference numerals in FIGS. 5 and 6 correspond to those in FIG. 1. In this embodiment, both of the inner and outer blowers 12, 6 are attached to the fan case 50 placed on the bottom of the heat insulating wall 2, and the fan case divides each of the inner passage 13 and the outer passage 7 into two parts, respectively. The bottom of the aforementioned insulating wall 2 serves as the drain receiver 4B, which is provided with the drain pipe 4E. The outer passage 7 is divided into an upstream region 7A and a downstream region 7B with regard to the flow of the air therethrough and both of the regions communicate with each other through an outer passage high pressure chamber 51 positioned in the center of the fan case 50 as shown in FIG. 5. The inner passage 13 is also divided into an upstream region 13A and a downstream region 13B, and both of the regions communicate with each other through inner passage high-pressure chamber 52 positioned in laterally opposite sides of the fan case 50.

In the aforementioned third cycle in the refrigerator construction as has been described, air flows as shown in broken arrows in FIG. 5 to produce the major circulated air for cooling the storage chamber 17 and the minor circulated air for defrosting the inner heat exchanger 11 and heating the drain receiver 4B.

In operating the aforementioned low-temperature showcase 1, the inner heat exchanger 11 is defrosted by forcibly heating it with a heat source for defrosting. At the same time, when the outer heat exchanger 5 is worked for refrigeration, a part of the air circulating in the outer passage 7 flows from the window 4C to the inner passage 13. The inner and outer blowers 12, 6 are controlled to cause the air to flow in a direction reverse to the direction of air flow during the refrigeration operation of the inner heat exchanger 11, so that the major circulated air for cooling the storage chamber 17, which takes the route of: outer heat exchanger 5—outer air outlet 8—opening 3—outer air inlet 9—outer heat exchanger 5 and the minor circulated air for heating the drain receiver 4B, which takes the route of: window 4C—inner heat exchanger 11—inner air inlet 15—outer air inlet 9—window 4C are produced.

Accordingly, a part of the major circulated air having a relatively high temperature before heat exchange in the outer heat exchanger 5 flows into the inner heat exchanger 11, is heated with the heat source for defrosting, and then flows along the surface of the drain receiver 4B, whereby the temperature of the air for heating the drain receiver 4B rapidly rises to 0° C. or over. As a result, the temperature of the drain receiver 4B rapidly rises to 0° C. or over, pieces of ice falling from the inner heat exchanger 11 melt rapidly, and water is drained well. In addition to that, the inner heat exchanger 11 is rapidly defrosted because frost built up on the inner heat exchanger 11 rapidly melts.

In each of the aforementioned embodiments of the low-temperature showcase of the present invention, when the inner heat exchanger is worked for defrosting and the outer heat exchanger is worked for refrigeration, a part of the major circulated air having a relatively high temperature before heat exchange in the outer heat exchanger flows into the inner heat exchanger as the minor circulated air, is heated with a heat source for defrosting and then flows along the surface of the drain receiver. Accordingly, the temperature of the air for heating the drain receiver rapidly rises to 0° C. or over, and hence the temperature of the drain receiver rapidly rises to 0° C. or over. Additionally, pieces of ice falling from the inner heat exchanger rapidly melt, and water is drained well. Consequently, in resuming the refrigeration operation of the inner heat exchanger, production of blocks of ice and an ice cover in the drain receiver can be avoided in resuming the refrigeration operation of the inner heat exchanger.

What is claimed is:

1. A low-temperature showcase comprising:

a case main body having at one side thereof an inlet-outlet opening for commodities and including an inner wall; an outer wall and a partition wall defining between the inner and outer walls an inner passage and an outer passage for passing air therethrough, the partition wall having a window at a portion thereof between two heat exchangers;

the two heat exchangers disposed in the inner passage and the outer passage respectively for providing refrigeration cycles along with a compressor, a condenser and reducing valves, the heat exchanger in the inner passage being positioned upstream of and at a predetermined distance from the heat exchanger in the outer passage with respect to the same direction of air flow in each of said passages;

a blower disposed in each of the inner and outer passages respectively for passing air through the two passages in a first direction and adapted to form at least a double air curtain at the inlet-outlet opening with the air circulated through the inner and outer passages when at least the heat exchanger in the inner passage is operated for refrigeration;

passage change-over means for opening or closing the window in the partition wall; and control means for providing passage change-over means instructions to open the window and controlling the operation of each of the two blowers when the heat exchanger in the inner passage is operated for defrosting and the heat exchanger in the outer passage is operated for refrigeration to direct a part of the air passing through the outer passage to flow through the open window into the heat exchanger in the inner passage in a second direction reversed to the first direction of air flow during the operation of the heat exchanger in the outer passage for refrigeration.

2. A low-temperature showcase according to claim 1, wherein the control means provides the blower in the outer passage instructions to rotate in the same direction during the operation of the heat exchanger in the inner passage for defrosting and the heat exchanger in the outer passage is operated for refrigeration, but provides the blower in the inner passage an instruction to stop.

3. A low-temperature showcase according to claim 1, wherein the control means provides the blower in the outer passage instructions to rotate in the same direction during the operation of the heat exchanger in the inner passage for defrosting and the heat exchanger in the outer passage is operated for refrigeration, but provides the blower in the inner passage instructions to rotate in the direction reverse to the rotational direction during the operation of the heat exchanger in the inner passage for defrosting and the heat exchanger in the outer passage is operated for refrigeration.

4. A low-temperature showcase according to claim 1, wherein the passage change-over means blocks with a damper the inner passage downstream from the window with regard to flow of air when the window is opened in accordance with an instruction of the control means.

5. A low-temperature showcase according to claim 1, wherein the case main body is provided with a drain receiver on the bottom of the partition wall.

6. A low-temperature showcase according to claim 1, wherein the heat exchanger in the inner passage passes therethrough a high temperature and high pressure gas refrigerant from the compressor in a refrigeration cycle to produce a liquid refrigerant and the heat exchanger in the outer passage passes the liquid refrigerant therethrough to evaporate it into gas state when the former exchanger is operated for defrosting and the latter exchanger is operated for refrigeration.

7. A low-temperature showcase according to claim 1, wherein the heat exchanger in the inner passage passes therethrough a high temperature liquid refrigerant from the condenser in the refrigeration cycle to produce a supercooled liquid refrigerant and the heat exchanger in the outer passage passes the supercooled liquid refrigerant therethrough to evaporate it into gas state when the former exchanger is operated for defrosting and the latter exchanger is operated for refrigeration.

* * * * *